US010472900B2

(12) United States Patent
Harbison et al.

(10) Patent No.: US 10,472,900 B2
(45) Date of Patent: Nov. 12, 2019

(54) BEND STIFFENER

(71) Applicant: Trelleborg Offshore UK Ltd., Skelmersdale, Lancashire (GB)

(72) Inventors: Austin Harbison, Liverpool (GB); Mohammed Bilal Hussain, Bolton (GB); Stuart William Turton, Skelmersdale (GB); Jonathan Lloyd Fox, Wigan (GB); Lewis John Watts, Preston (GB)

(73) Assignee: Trelleborg Offshore UK Ltd., Skelmersdale (GB)

( * ) Notice: Subject to any disclaimer, the term of this patent is extended or adjusted under 35 U.S.C. 154(b) by 0 days.

(21) Appl. No.: 15/742,819

(22) PCT Filed: Jul. 5, 2016

(86) PCT No.: PCT/GB2016/052023

§ 371 (c)(1),
(2) Date: Jan. 8, 2018

(87) PCT Pub. No.: WO2017/006105

PCT Pub. Date: Jan. 12, 2017

(65) Prior Publication Data

US 2018/0209220 A1 Jul. 26, 2018

(30) Foreign Application Priority Data

Jul. 9, 2015 (GB) ..... 1512011.6

(51) Int. Cl.
*E21B 17/01* (2006.01)
*E21B 19/00* (2006.01)
*E21B 43/01* (2006.01)

(52) U.S. Cl.
CPC ..... *E21B 17/017* (2013.01); *E21B 19/004* (2013.01); *E21B 43/0107* (2013.01)

(58) Field of Classification Search
CPC ..... E21B 17/017; E21B 19/004
(Continued)

(56) References Cited

U.S. PATENT DOCUMENTS 5,526,846 A 6/1996 Maloberti
6,220,303 B1 4/2001 Secher et al.
(Continued)

FOREIGN PATENT DOCUMENTS

GB 2040014 A 8/1980
GB 2291686 A 1/1996
(Continued)

OTHER PUBLICATIONS

European Patent Office, International Search Report, PCT/GB2016/052023, dated Mar. 1, 2017.
(Continued)

*Primary Examiner* — Sean D Andrish
(74) *Attorney, Agent, or Firm* — Cahn & Samuels, LLP

(57) ABSTRACT

A bend stiffener (50) includes an elongate stiffener body (52) having polymer material and two ends. A passage (58) extends through the stiffener body from end to end for receiving and embracing a flexible member (60). The stiffener body includes a coupling (66) for mounting the stiffener body in cantilever fashion. The stiffener body is sufficiently flexible to curve somewhat along with the flexible member under a bending load but is sufficiently stiff to resist excessive curvature which could damage the flexible member, and sufficiently resilient to recover its original shape afterwards. The stiffener body includes at least two stiffener body parts (64*a*, 64*b*) defining the passage. Each stiffener body part includes a respective interface member (68, 70) having material stiffer than the polymer material of the stiffener
(Continued)

body. A securing arrangement (80, 83) secures the interface members of different stiffener body parts together around the elongate flexible member.

18 Claims, 19 Drawing Sheets

(58) Field of Classification Search
USPC ..... 405/168.1, 168.2
See application file for complete search history.

(56) References Cited

U.S. PATENT DOCUMENTS

| | | | |
|---|---|---|---|
| 6,276,456 | B1 | 8/2001 | Head |
| 7,387,469 | B2 | 6/2008 | Duggan |
| 7,469,722 | B2 | 12/2008 | Berland |
| 7,967,070 | B2 | 6/2011 | Reddy |
| 8,939,214 | B2 | 1/2015 | Litherland et al. |
| 9,482,061 | B2 | 11/2016 | Latimer et al. |
| 2011/0203802 | A1* | 8/2011 | Curtis ..... E21B 19/004 166/335 |
| 2011/0226527 | A1 | 9/2011 | Ritchie-Bland |
| 2012/0304447 | A1* | 12/2012 | Smith ..... F16L 57/02 29/434 |
| 2017/0159373 | A1 | 6/2017 | Duggan et al. |

FOREIGN PATENT DOCUMENTS

| | | | |
|---|---|---|---|
| GB | 2492109 | A | 12/2012 |
| WO | 01/75262 | A1 | 10/2001 |
| WO | 2014/052331 | A2 | 4/2014 |

OTHER PUBLICATIONS

European Patent Office, Written Opinion, PCT/GB2016/052023, dated Mar. 1, 2017.

Lane, M. et al, "Bend Stiffeners for Flexible Risers," Offshore Technology Conference, May 4, 1995, pp. 345-353.

* cited by examiner

BEND STIFFENER

This application is the National Stage of International Application No. PCT/GB2016/052023, filed on Jul. 5, 2016, which claimed the benefit of Great Britain Application No. 1512011.6 filed Jul. 9, 2015, which are hereby both incorporated by reference.

I. FIELD OF THE INVENTION

The present invention relates to bend stiffeners.

II. BACKGROUND OF THE INVENTION

A bend stiffener serves to locally protect an elongate flexible member from excessive curvature under bending loads. The flexible member in question may for example be a subsea pipe such as a riser used to conduct hydrocarbons from the sea floor to a production platform, but may be any of a wide range of risers, pipelines, flowlines, umbilicals, power cables, tension cables, streamers or the like, according to the application. Bend stiffeners are often—but not always—used underwater.

It must be understood that although the term "flexible" used in relation to the underwater member on which the bend stiffener is to be mounted implies that the member is capable of flexure, the member in question may in practice be a substantial structure with a high degree of stiffness, as in the case of a large oil riser which bends due to the large moments applied to it.

One known form of bend stiffener 10 is represented, in simplified form, in FIG. 1 and comprises a frusto-conical stiffener body 12 with a cylindrical through-going passage (which is internal detail not seen in this drawing) receiving and embracing a flexible member 14 passing though the bend stiffener. A relatively rigid root coupling 16 comprising a flange serves to mount a wider root 18 of the bend stiffener to some fixed structure (not shown). In this way the stiffener body 12 is mounted in cantilever fashion, its root 18 being fixed and its narrower, free, end 20 being able to move as the stiffener body 12 and the member 14 within it flex under a bending load. The drawing shows the stiffener body 12 to be curved but this is the effect of such loading, in the absence of which the stiffener body 12 is straight in this example. The stiffness of the frusto-conical body reduces progressively from the root 18 to the free end 20 and in this way the bend stiffener distributes a bending moment over its length, ensuring that the riser is not subject to a localised—and potentially large—bending moment where it emerges from the fixed structure. The fixed structure in question may for example be an "I" tube on a production platform such as an oil rig. Note that although this is fixed in the sense that it is rigidly anchored to the platform, it is not necessarily static—the platform may be moving according to factors including tide.

A practical example of a bend stiffener having this general form is provided in GB2291686.

Such bend stiffeners are dynamic devices, in that they are subject to and must accommodate variations of load and repeated flexure. They must be designed to protect the flexible member under a range of load cases. They are also required to have a long design lifetime. Fatigue performance must be taken into account to achieve this.

The root coupling 16 needs to be secured to the stiffener body 12 in a durable fashion which enables it to sustain the bending loads applied to the bend stiffener. A known type of root coupling 16 comprises a fabricated steel structure which is incorporated into the stiffener body 12 during its moulding The root coupling typically has features of shape which enable it to engage with the material of the stiffener body 12 and so form a secure and rigid coupling to it. Examples of such couplings are to be found in U.S. Pat. No. 5,526,846 (Maloberti), especially in FIGS. 6, 7 and 8. Structures consisting of welded rods may be used in place of those seen in '846.

The bend stiffener disclosed in GB2291686 is formed as an unbroken cylinder so that mounting it necessarily involves passing it over a free end of the flexible member such as 14. This has some disadvantages. Once the flexible member is installed for use, the end of the flexible member is typically mated to some other structure making removal/replacement of the bend stiffener impossible without disassembly of other parts of the installation.

In the case of a bend stiffener used on a marine riser, for example, a riser end fitting can only be installed once the bend stiffener has been mounted. This means that installing the bend stiffener is a task on the critical path. Delays are potentially expensive. There may be a large lead time in manufacture of a bend stiffener for a particular installation which can lead to users taking risks in project planning. Practical experience shows that this can result in repeated revision of bend stiffener design.

If a bend stiffener of the type found in GB2291686 suffers damage in service, replacing it is a complex process and results in lost production time.

There are known bend stiffeners which are able to be mounted upon the flexible member without access to a free end. FIG. 2 illustrates one such bend stiffener 30 whose stiffener body 32 is split along a line 34, enabling it to be opened out, the stiffener body 32 being resiliently deformed in the process, so that the flexible member is able to be introduced laterally. Integrally moulded upstands 36 on either side of the split 34 receive threaded fasteners 38 at intervals along their length, to close the split line 34.

GB2492109 concerns a bend stiffener whose body is formed in two separable semi-frusto-conical parts for assembly around the flexible member, which are to be held together in use by means of straps passed around their circumference. Loose rings are placed in internal, circumferential troughs in the two body parts to transmit shear from one to the other. This construction provides multiple points of stress concentration considered to limit fatigue lifetime, as well as being somewhat complex in terms of manufacture and assembly. Integrity of the structure depends on maintenance of tension in the straps used to secure it together and creep of the material of the bend stiffener body can lead to loss of this tension. In turn, this results in loss of contact pressure between mating faces of the parts of the bend stiffener body and loss of friction between these faces. It is considered that slip between the faces could become problematic, given the dynamic nature of the loads to which a bend stiffener is exposed, and could eventually lead to an increased risk of structural failure.

III. SUMMARY OF THE INVENTION

In accordance with a first aspect of the present invention there is a bend stiffener for locally protecting an elongate flexible member from excessive curvature, the bend stiffener comprising an elongate stiffener body which comprises polymer material and which has a root end and a free end, a passage extending through the stiffener body from the root end to the free end for receiving and embracing the flexible member and a coupling at or toward the root end of the stiffener body for mounting the stiffener body in cantilever fashion, the stiffener body being sufficiently flexible to curve somewhat along with the flexible member when the flexible member suffers a bending load but sufficiently stiff to resist excessive curvature which could otherwise damage the flexible member, and being sufficiently resilient to recover its original shape upon relief of the bending load, the stiffener body comprising at least two stiffener body parts which together define the passage and which are able to be separated from one another to enable the flexible member to be introduced to the passage, and subsequently assembled to one another around the flexible member to ready the bend stiffener for use, each of the stiffener body parts being provided with a respective interface member which comprises material which is stiffer than the polymer of the stiffener body, and the bend stiffener further comprising a securing arrangement for securing the interface member of one stiffener body part to the interface member of another stiffener body part to secure the stiffener body parts to one another.

The bend stiffener according to the present invention can be fitted without need of access to a free end of the flexible member, facilitating installation, replacement and retrofitting. The interface members aid in interfacing the stiffener body parts while alleviating fatigue problems associated with coupling the polymer stiffener body parts together directly, which is of particular importance in dynamic applications. The interface members can be made from materials whose fatigue properties are well known and whose fatigue lifetime is suitably long. For example they may be made of metal. The long term behaviour of metal to metal couplings—such as bolted joints—is well known and understood, and their fatigue lifetime can be ample for present purposes. Problems of creep involved in coupling polymer components directly to one another are avoided (for example a bolted connection between polymer components could loosen over time, especially under dynamic loading, due to material creep, and loss of pressure from such a connection could lead to problems of shear and friction at the relevant connection under such loading). The interface member may also provide a route for conduction of heat away from the flexible member within, which is advantageous in certain applications, especially since keeping the bend stiffener and the flexible member cool can in itself improve fatigue performance. The precise dimensions of the polymer stiffener body parts may vary somewhat. Where for example they comprise thermoset plastics, they may shrink as they cool during the moulding process. The incorporation of interface members of relatively rigid material makes it possible to provide engagement features on the stiffener body parts which are accurately positioned and will thus line up correctly with one another during assembly of the bend stiffener. Whereas fatigue lifetime and/or loading capacity of current split dynamic stiffeners, reliant on direct connection of polymer components, are limited by the low allowable stresses on these connections, the present invention alleviates this design constraint.

The interface members may comprise materials other than metal. Suitable materials include fibre reinforced plastics, carbon fibre reinforced plastics and glass fibre reinforced plastics. A suitable material, comprising a woven fabric reinforcement in a thermosetting resin matrix, is produced by Orkot® Marine and offered under the trade mark Orkot®.

The welded root couplings of some existing bend stiffeners are somewhat complex to manufacture, which can increase the lead time needed to fulfil a customer's order, as well as cost. Also welded joints can be points of stress concentration and may require inspection. Provision of an improved root coupling is an object of a further aspect of the present invention.

According to a second aspect of the present invention there is a coupling for securing a root of a bend stiffener to a support structure, the coupling comprising a coupling body to be embedded in a moulded bend stiffener body and a set of upstands secured to the coupling body and arranged and configured to be surrounded and embraced by the material of the bend stiffener body to secure the coupling to the bend stiffener, wherein the upstands each comprise a shaped member secured at two separate locations to the coupling body.

IV. BRIEF DESCRIPTION OF THE DRAWINGS

Specific embodiments of the present invention will now be described, by way of example only, with reference to the accompanying drawings, in which:—

Figure 11:
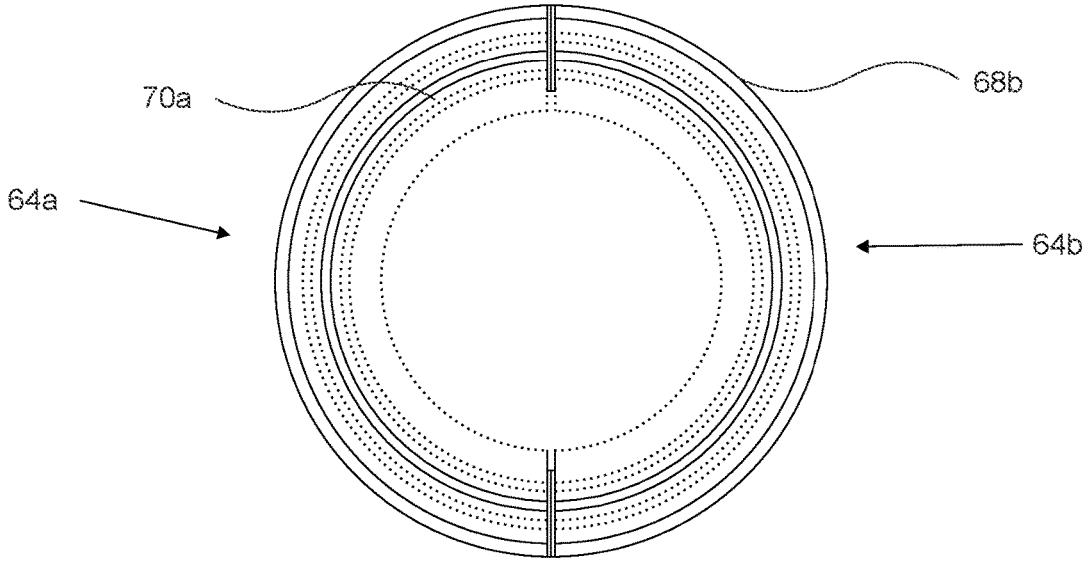
Figure 12:
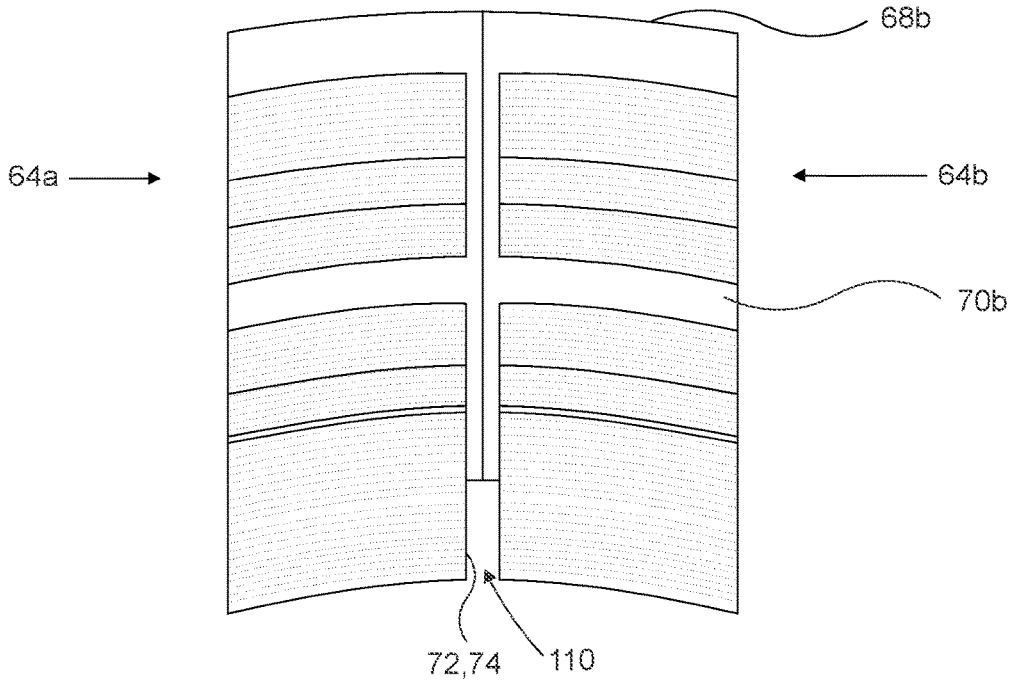
Figures 14A, 14B, 14C, 14D:
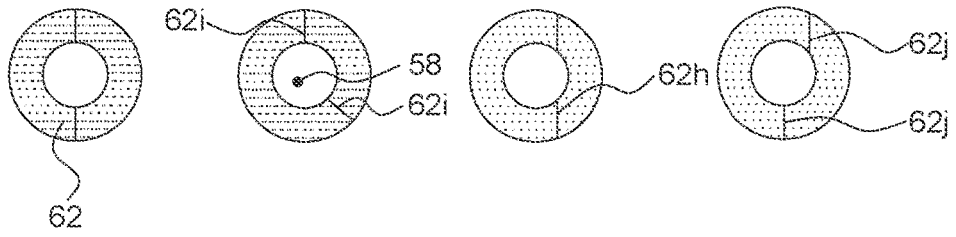
Figures 14E, 14F, 14G, 14H:
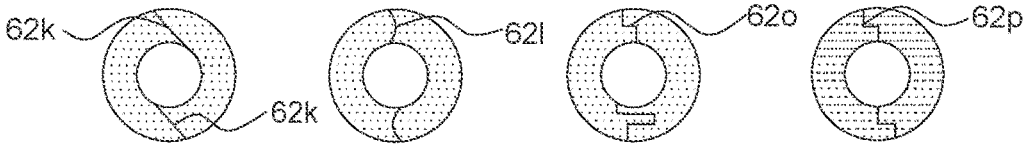
Figures 14I, 14J, 14K, 14L:
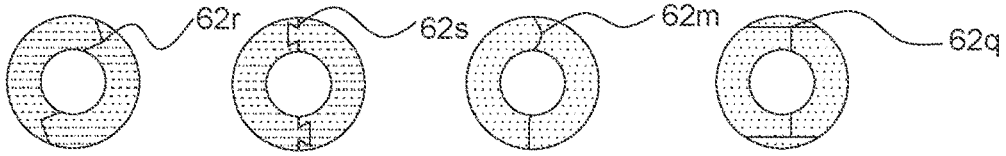
Figures 14M, 14N, 14O:
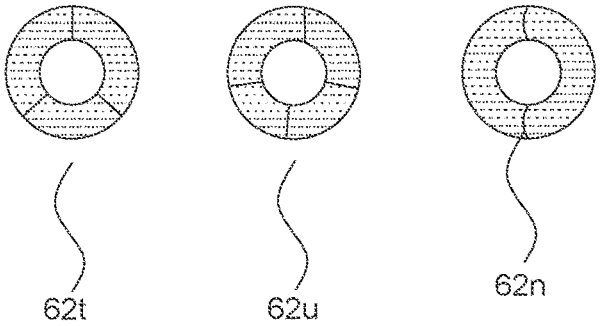
Figure 15A:
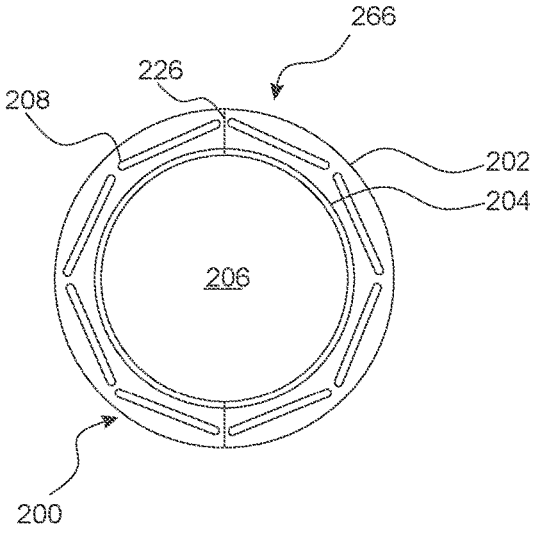
Figure 15B:
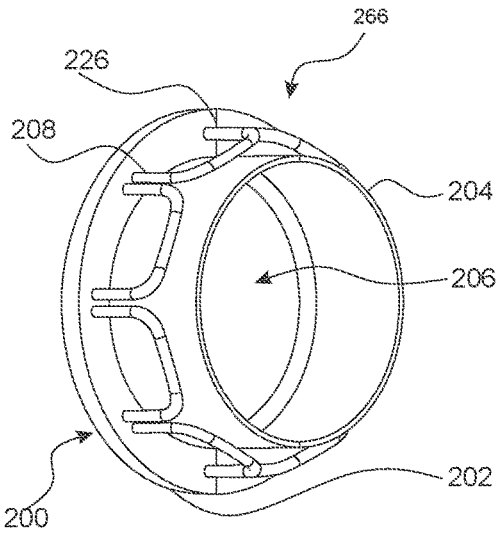
Figure 16A:
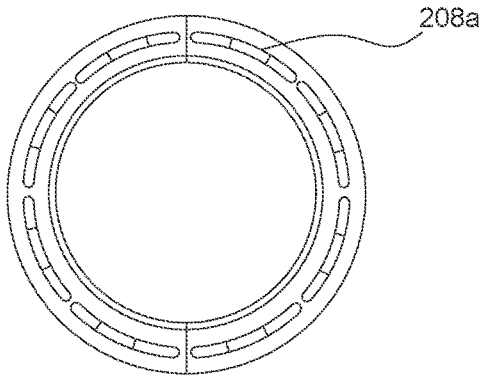
Figure 16B:
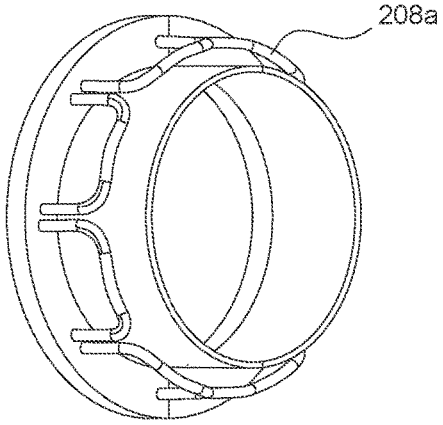
Figure 17A:
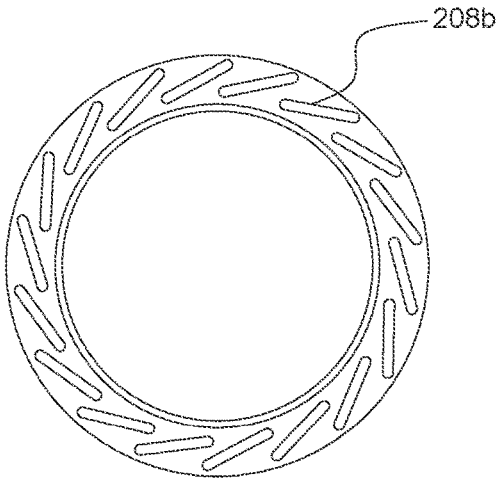
Figure 17B:
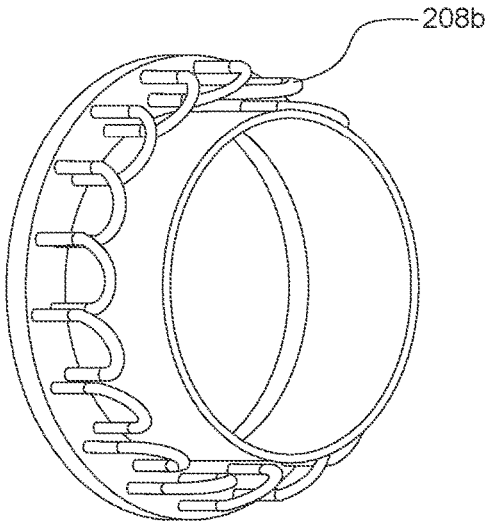
Figure 18A:
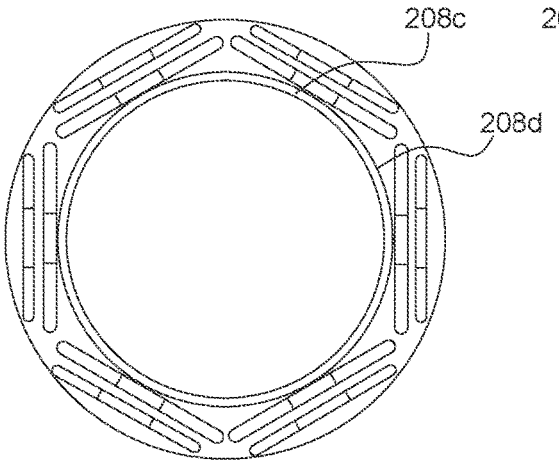
Figure 18B:
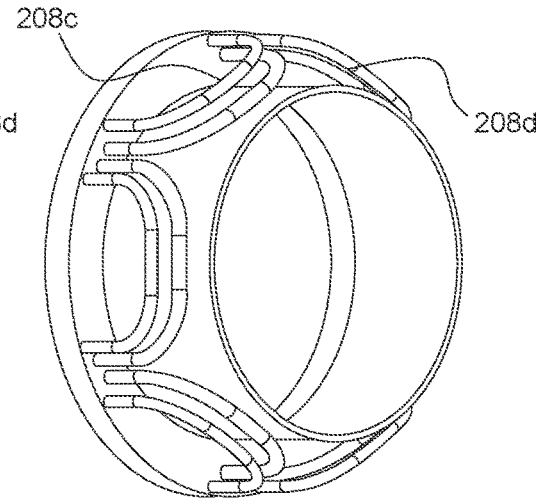
Figure 19:
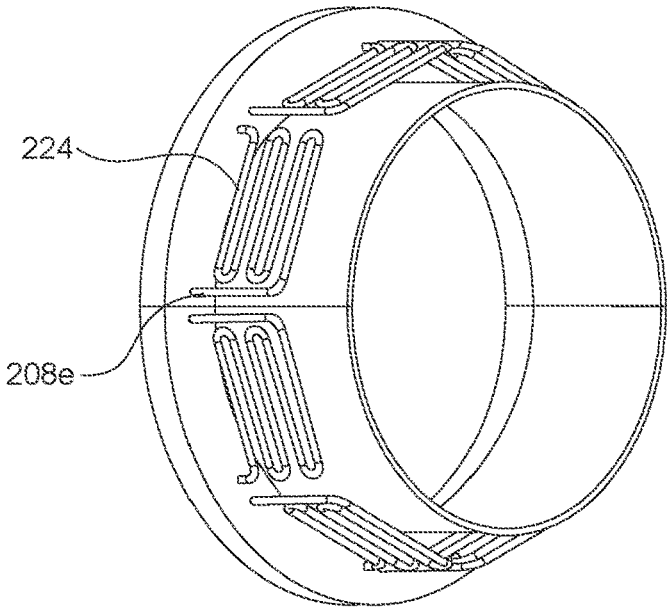
Figure 20:
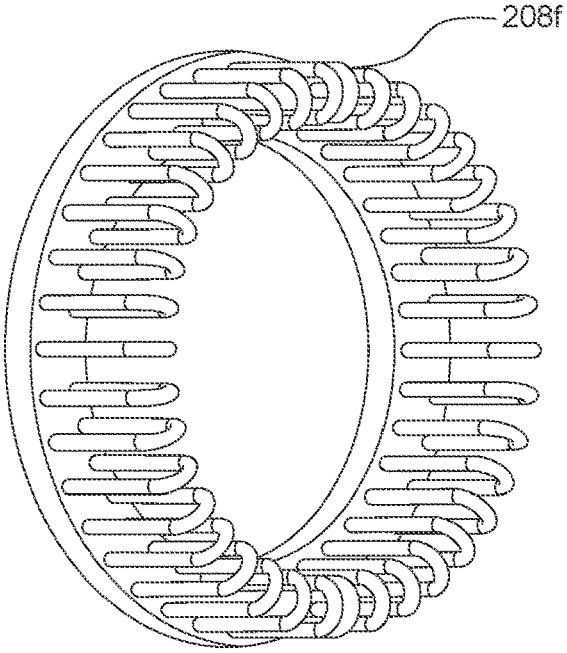
Figure 21:
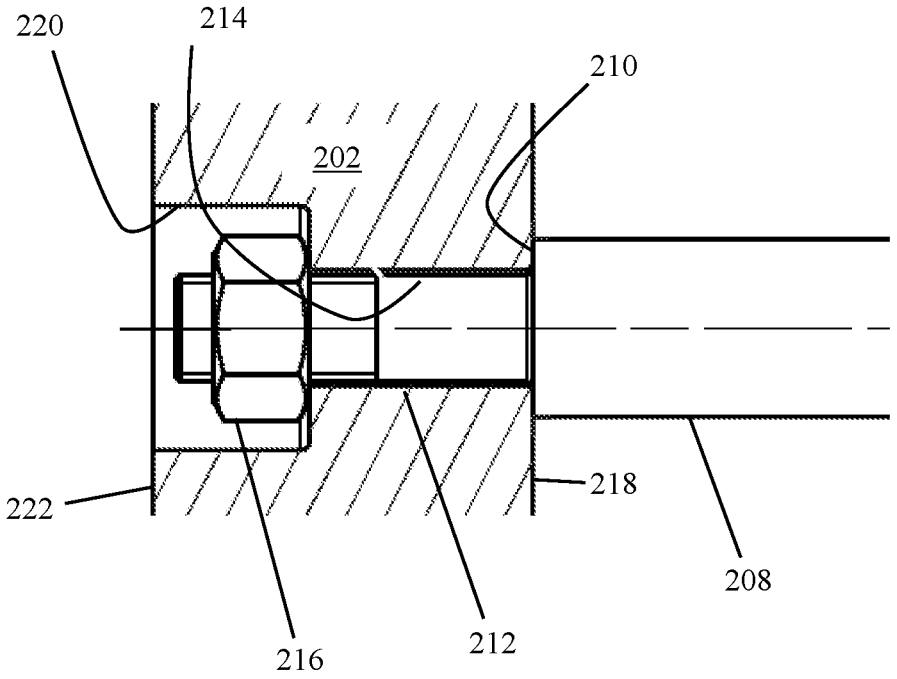
Figure 22A:
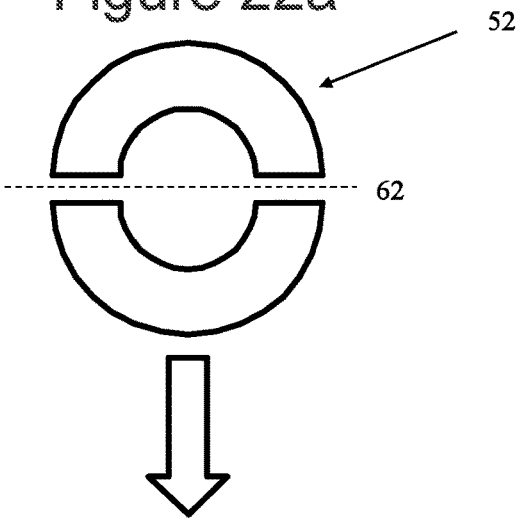
Figure 22B:
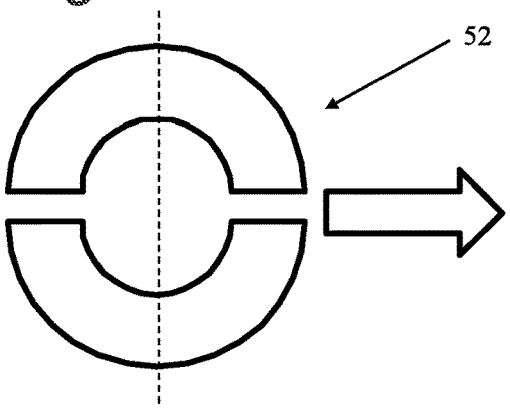
Figure 22C:
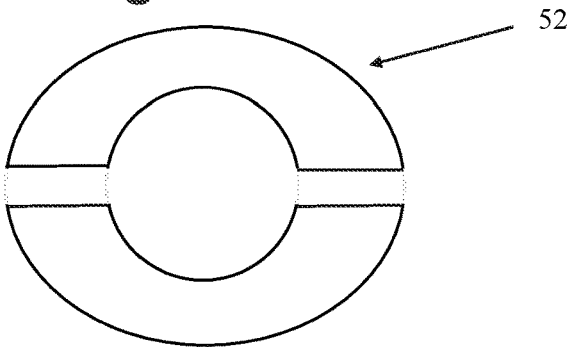
Figure 23:
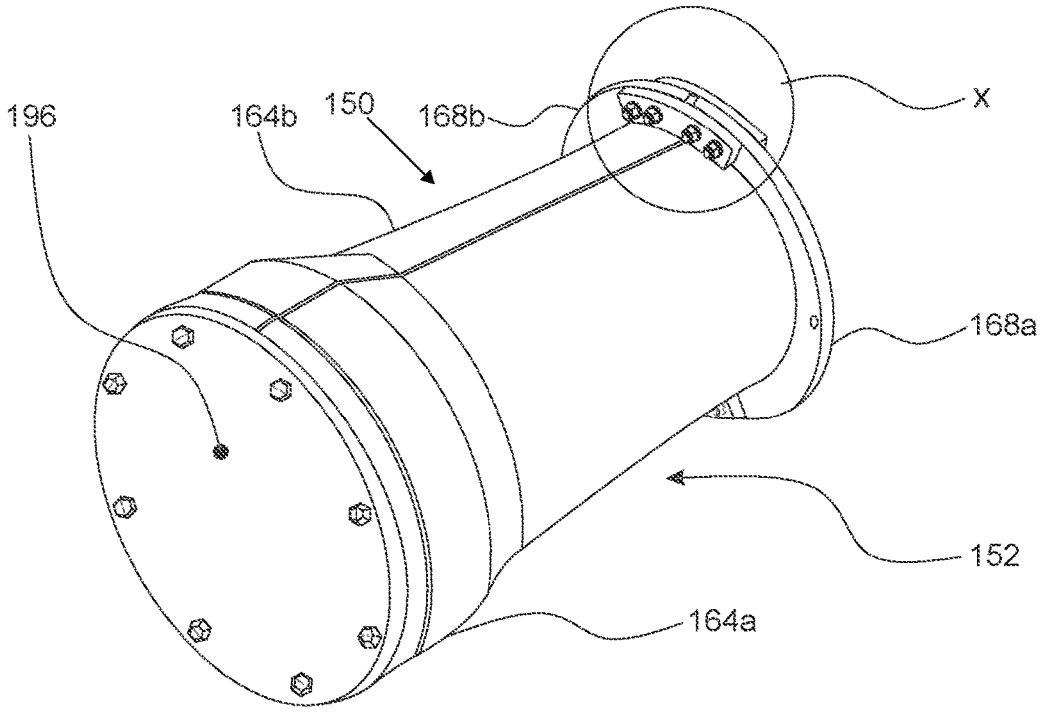
Figure 24:
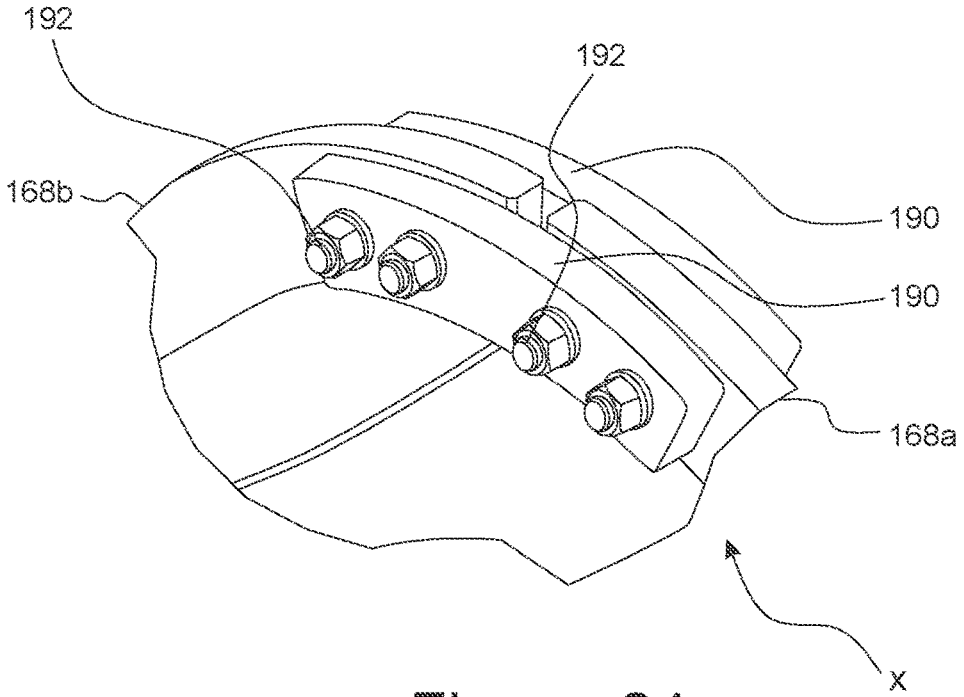
Figure 25:
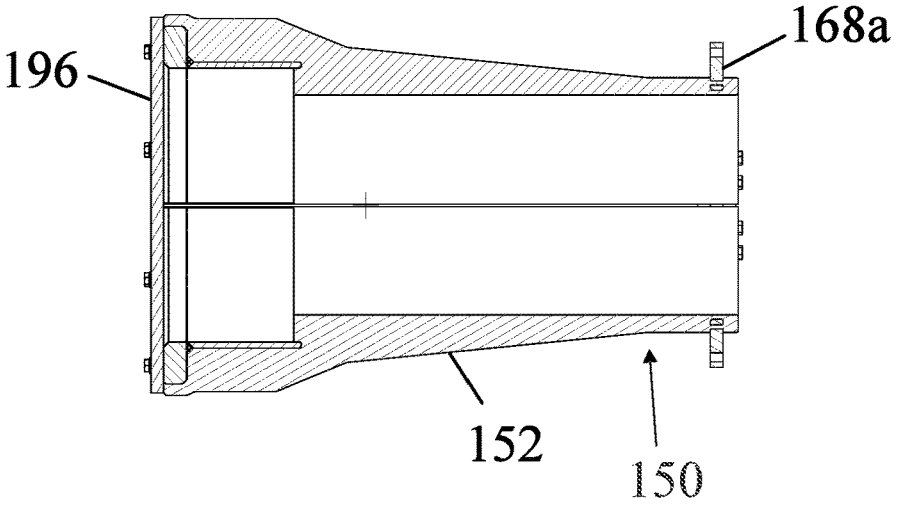
Figure 26:
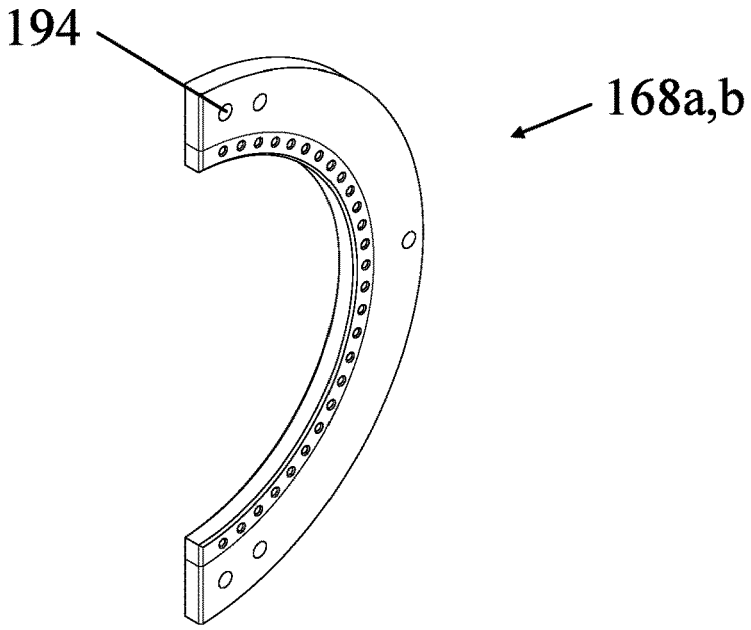
Figure 27:
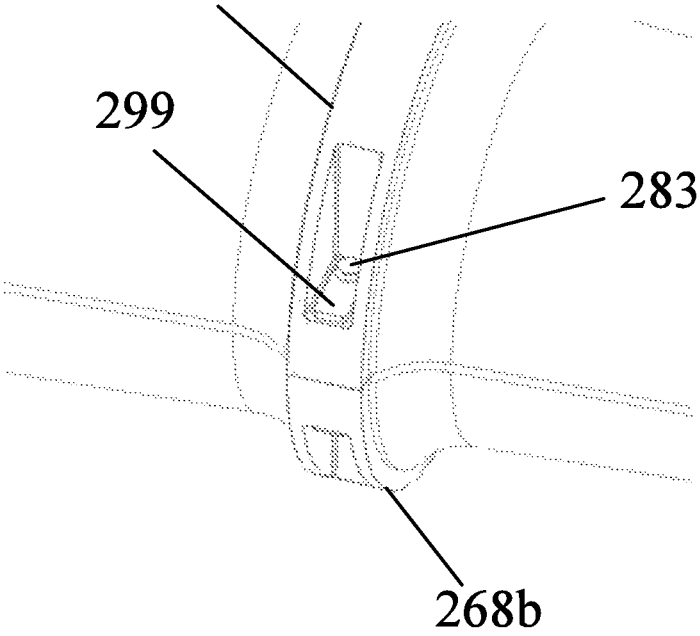
Figure 28:
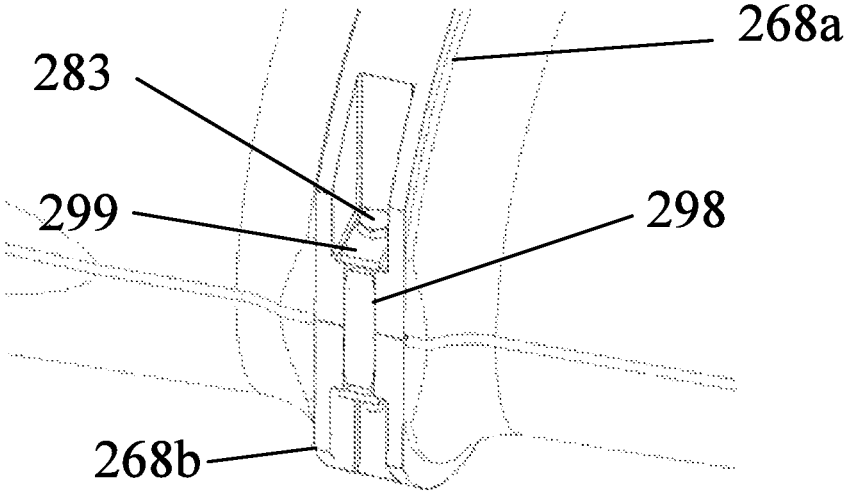
Figure 29:
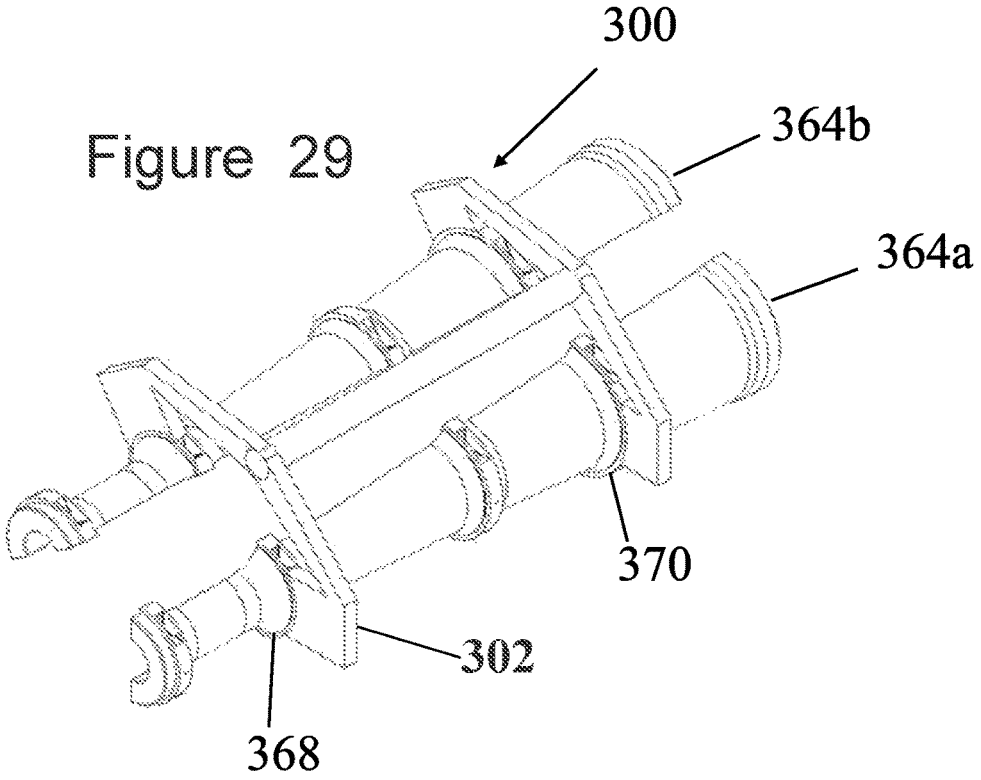
Figure 30:
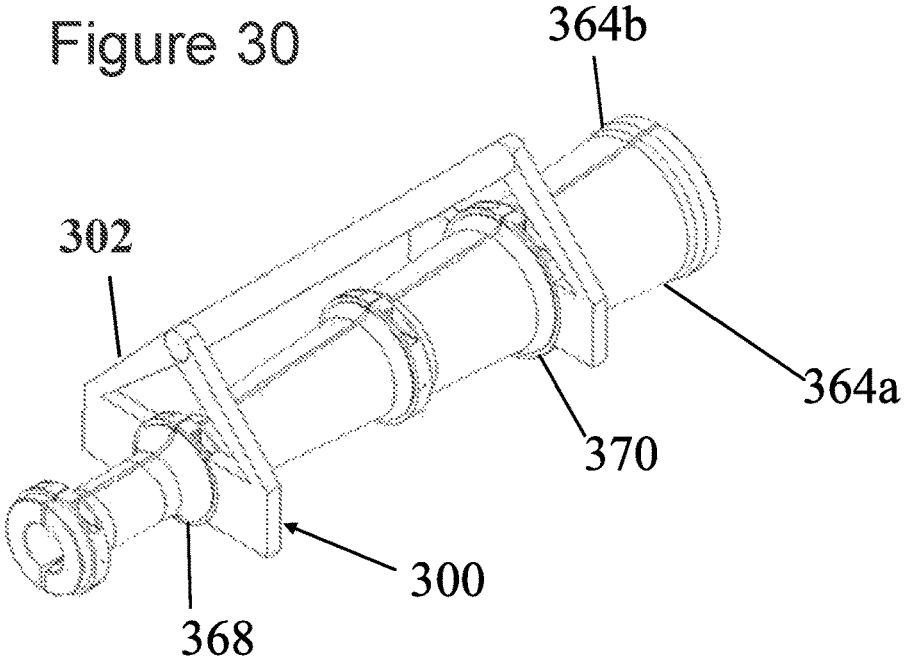

FIGS. 8*a*-8*h* show a set of variants of the interface member in plan;

FIGS. 9*a*-9*e* show a further set of variants of the interface member in perspective;

FIGS. 10*a*-10*d* show still a further set of variants of the interface member in perspective;

FIG. 11 is a view of a bend stiffener embodying the present invention along an axial direction;

FIG. 12 shows a portion of FIG. 11 to an enlarged scale;

FIGS. 13*a*-13*h* show, in simplified form, a set of variants of a bend stiffener embodying the present invention, viewed along a radial direction;

FIGS. 14*a*-14*o* show, in simplified form, a further set of variants of a bend stiffener embodying the present invention viewed in cross section;

FIGS. 15*a* and 15*b* are respectively a plan view and a view from in front and to one side of a root coupling for a bend stiffener according to an aspect of the present invention;

FIGS. 16*a* and 16*b* are respectively a plan view and a view from in front and to one side of a further root coupling for a bend stiffener according to an aspect of the present invention;

FIGS. 17*a* and 17*b* are respectively a plan view and a view from in front and to one side of still a further root coupling for a bend stiffener according to an aspect of the present invention;

FIGS. 18*a* and 18*b* are respectively a plan view and a view from in front and to one side of yet a further root coupling for a bend stiffener according to an aspect of the present invention;

FIG. 19 is a view from in front and to one side of another root coupling for a bend stiffener according to an aspect of the present invention;

FIG. 20 is a view form in front and to one side of yet another root coupling for a bend stiffener according to an aspect of the present invention;

FIG. 21 is a scrap sectional view of a portion of a root coupling according to an aspect of the present invention showing the manner of attachment of an upstand to a coupling body;

FIGS. 22*a* to 22*c* are cross sections through bend stiffeners embodying the present invention;

FIG. 23 is a view of a further bend stiffener embodying the present invention;

FIG. 24 shows a detail of FIG. 23 in an enlarged scale;

FIG. 25 is a section in an axial plane through the bend stiffener of FIG. 23;

FIG. 26 shows an interface member used in the bend stiffener of FIG. 23;

FIGS. 27 and 28 show a detail of yet a further bend stiffener embodying the present invention, FIG. 28 being partly cut-away to reveal internal features; and FIGS. 29 and 30 show a bend stiffener embodying the present invention along with a handling tool, the bend stiffener halves being separated in FIG. 29 and brought together by use of the tool in FIG. 30.

V. DETAILED DESCRIPTION OF THE DRAWINGS

Figure 3:
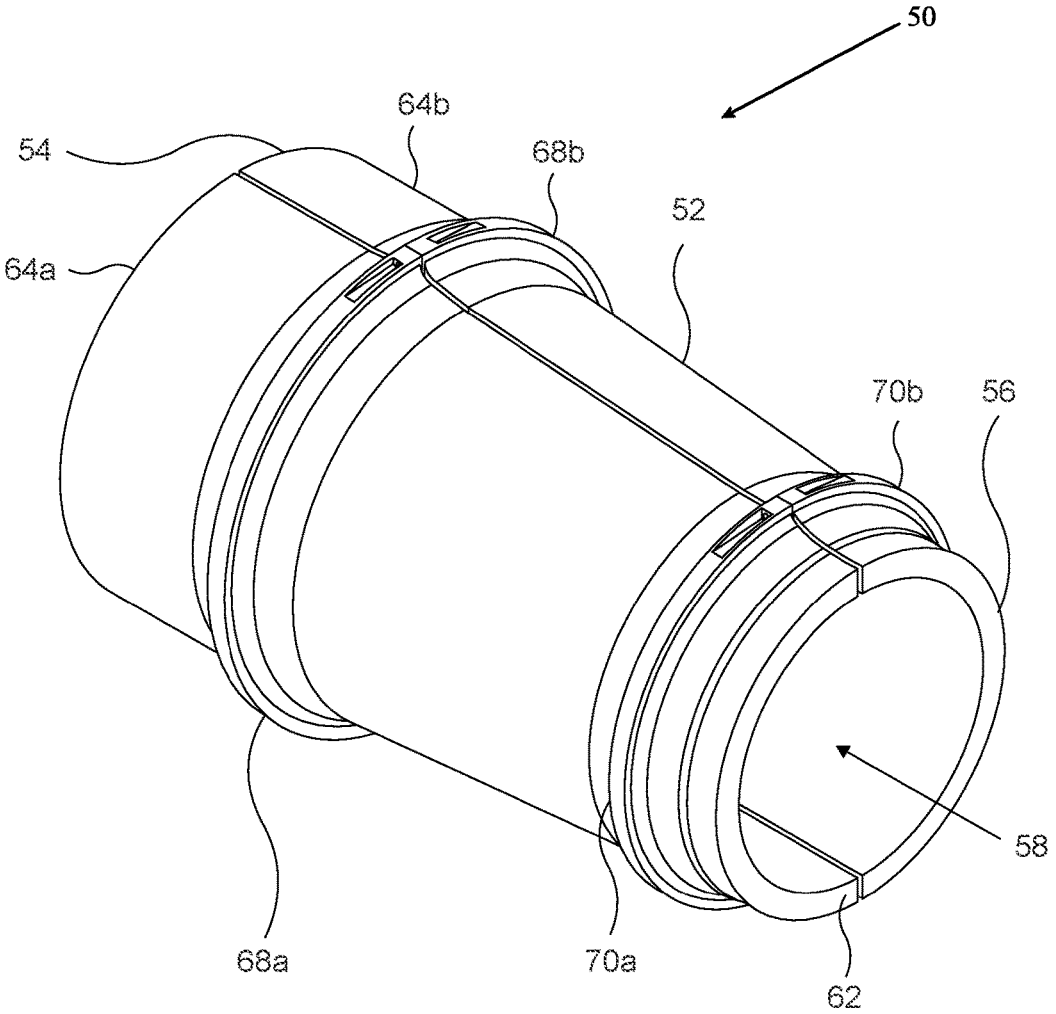
FIG. 3 shows a bend stiffener embodying the present invention.
Figure 4:
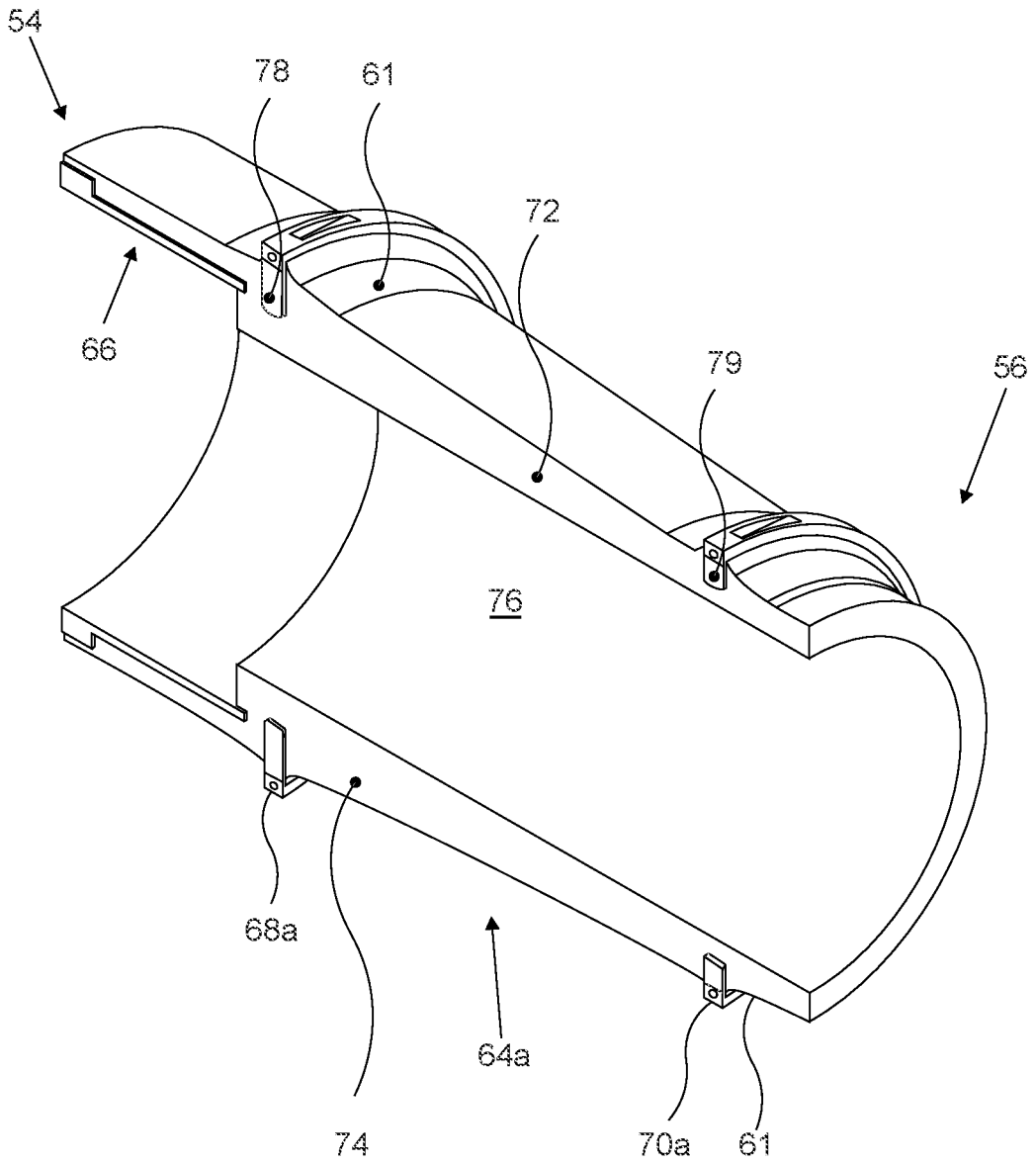
FIG. 4 shows a single stiffener body of the FIG. 3 bend stiffener, certain internal detail being visible.
Figure 5:
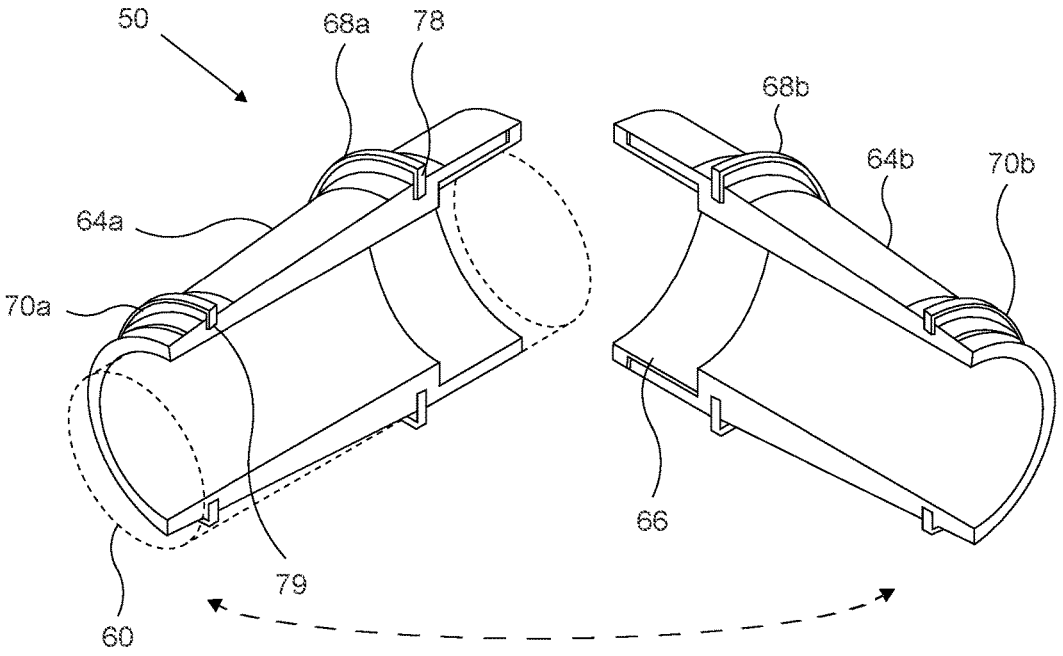
FIG. 5 shows the FIG. 3 bend stiffener in disassembled form.

With reference to FIGS. 3 to 5, a bend stiffener 50 embodying the present invention comprises an elongate stiffener body 52 which, when assembled, has a substantially frusto-conical exterior tapering from a wider root 54 to a narrower free end 56 and providing a cylindrical, axially aligned, though-going passage 58 in which a flexible member 60 (see FIG. 5) is to be received and embraced. The stiffener body 52 is split along a plane 62 containing the body's axis into first and second separable stiffener body parts 64*a* and 64*b*. Thus the bend stiffener 50 is able to be assembled around the flexible member 60 without need of access to a free end thereof.

The first stiffener body part 64*a* is represented on its own in FIG. 4. The second stiffener body part 64*b* is identically formed to the first, in this particular embodiment.

The stiffener body 52 comprises a material with sufficient flexibility and resilience that it can accommodate the flexure caused by loads applied to the flexible member 60 without structural failure, recovering its original shape when relieved of loading, and can survive repeated cycles of motion over a protracted design lifetime without suffering failure through fatigue. At the same time it must be sufficiently stiff to support the flexible member within, preventing it from adopting an excessively tight radius of curvature and distributing bending moments along its length. Elastomer materials may be used. Polyurethane is suitable, although other plastics materials, other polymer materials and other classes of materials could be substituted. Fibre reinforced plastics materials may be used.

The root 54 of the bend stiffener 50 is provided with a coupling 66 by means of which the bend stiffener 50 is able to be mounted to a supporting structure in cantilever fashion. In the present example the coupling 66 comprises a metal structure embedded in the stiffener body parts 64*a*, 64*b* and forming in the assembled bend stiffener 50 a cylindrical socket for receipt upon a male member such as a fixed tube. The coupling 66 may be split in two halves along the same plane 62 that divides the first and second stiffener body parts 64*a*, 64*b*, so that half the coupling 66 lies in the first body part 64*a* and the other half lies in the second stiffener body part 64*b*.

In accordance with the present invention, the stiffener body parts 64*a*, 64*b* incorporate respective interface members 68*a*, 68*b*, 70*a*, 70*b* through which the parts are to be secured to one another. The interface members comprise a material which is stiff in relation to the material of the remainder of the stiffener body 52. They may be formed of metal. Stainless steel is suitable.

The interface members 68, 70 extend, in the illustrated embodiment, around the full circumference of the stiffener body 52. That is, interface members 68*a* and 68*b* together form a ring around the circumference and likewise interface members 70*a* and 70*b* together form a ring around the circumference.

The external profile of the stiffener body 52 may be a plain frustum of a cone or it may include stress relief features such as the outwardly curved regions 61 seen adjacent the interface members 68*a*, 70*a* in FIG. 4. Other stress relief features such as chamfers, fillets etc may be adopted, especially in the vicinity of the interface members. Other shapes can be used for the stiffener body 52, according to the application.

Figure 1:
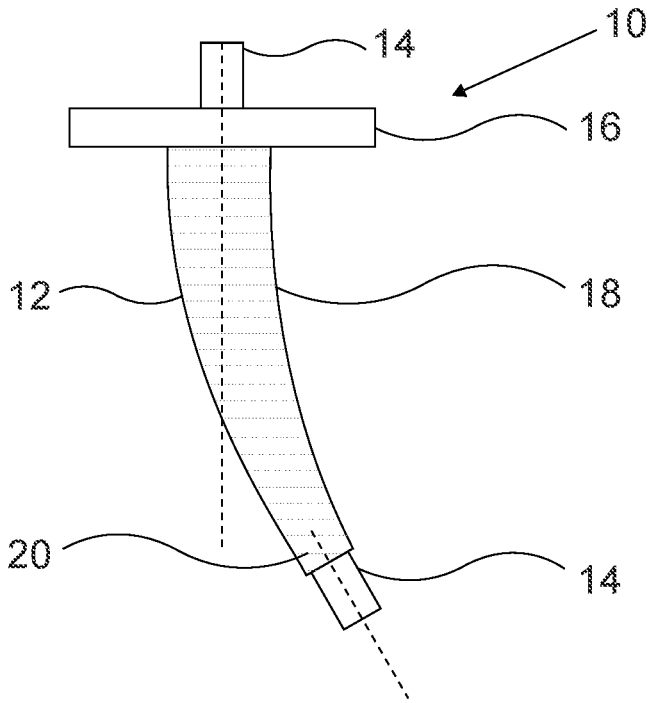
Figure 1 PRIOR ART
FIG. 1 is a simplified representation of a bend stiffener belonging to the prior art.
Figure 2:
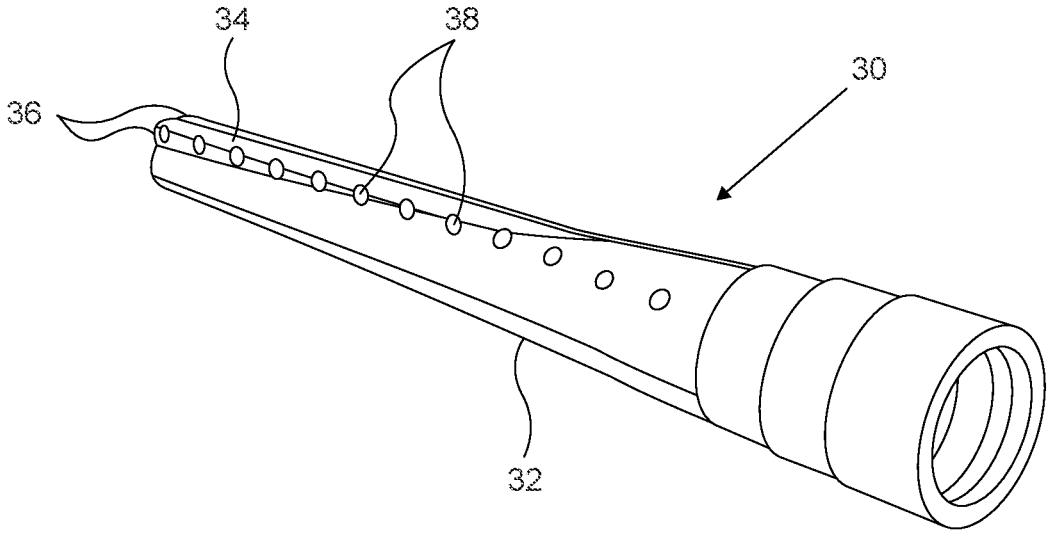
Figure 2 PRIOR ART
FIG. 2 shows a further bend stiffener belonging to the prior art, this version having a single split.

Looking at FIG. 4, it can be appreciated that the stiffener body part 64*a* has a pair of contact faces 72, 74 lying in the plane 62 of the split between the two body parts and separated from one another by a semi-cylindrical recess 76. The interface members 68*a*, 70*a* of this body part extend all the way from one contact face 72 to the other contact face 74 and their end faces 78, 79 lie in the split plane 62. In the assembled bend stiffener 50 the contact faces 72, 74 of the first stiffener body part 64*a* abut similarly formed contact faces of the second stiffener body part 64*b*. End faces 78, 79 of the interface members 68*a*, 70*a* of the first stiffener body part abut similarly formed end faces of the interface members 68*b*, 70*b* of the second stiffener body part. Because these end faces 78, 79 lie in the plane through which the stiffener body 52 is split, the interface members 68, 70 can be secured to one another without significant deformation of, or stress to, the material of the stiffener body 52. This is advantageous in terms of fatigue lifetime of the stiffener body 52, and is to be contrasted with for example the single split bend stiffener of FIG. 1, where the action of the threaded fasteners 38 is to locally pre-stress the material of the bend stiffener.

Some means is provided for securing the interface members 68*a*, 70*a* of the first stiffener body part 64*a* to the interface members 68*b*, 70*b* of the second stiffener body part. This may take a variety of forms, including joints using threaded fasteners (which may take the form of bolts), tension straps (which may comprise metal, polymer material or fibre reinforced polymer material), adhesive, adhesive tape, locking pins, latches or other means of mechanical engagement.

The interface members 68*a*, 68*b*, 70*a*, 70*b* may be provided with shaped locating features to assist in achieving and maintaining proper location. These may take the form of a spigot on one part for receipt in a socket of the other.

Figure 6:
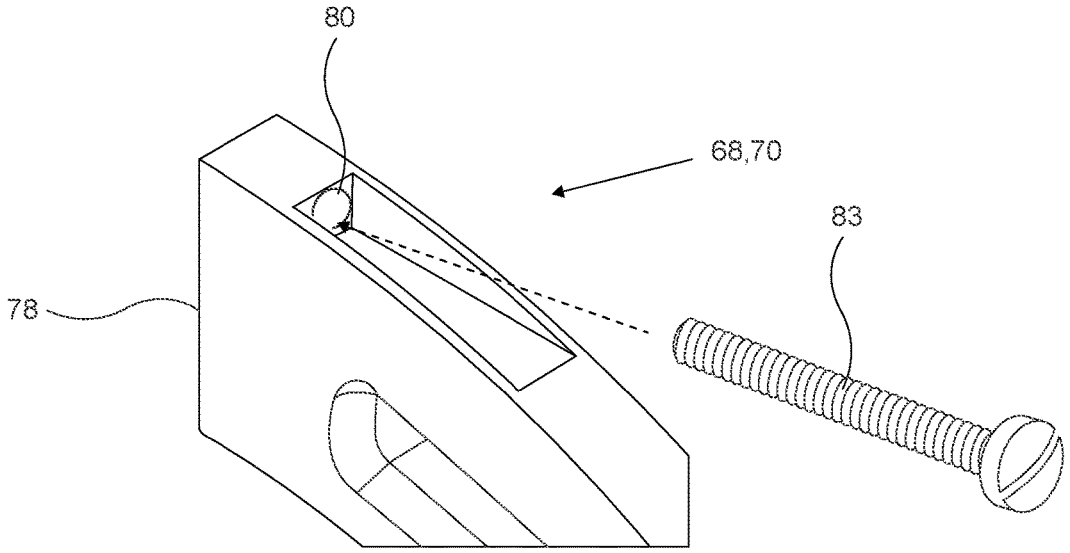
FIG. 6 is a scrap view of an end portion of an interface member used in embodiments of the present invention.

FIG. 6 shows how, in accordance with an embodiment, an end portion of the or each interface member 68*a*, 68*b*, 70*a*, 70*b* is formed with a circumferentially extending hole 80 for securing the interface members together. The holes 80 of neighbouring interface members are aligned during assembly and a fastener—typically a threaded fastener such as a machine screw 83—is passed through the aligned holes and serves to draw the end faces 78 of the interface members together. The holes 80 may be somewhat oversize or may be formed as slots to accommodate a degree of misalignment.

Typically the stiffener body parts 64*a*, 64*b* comprise moulded polymer material and the interface members are incorporated in them during the moulding process, so that the interface members are in intimate contact with the material of the stiffener body parts and are securely held by it. The interface members may be surrounded by the polymer material. Alternatively they may extend though its full depth.

Additionally or alternatively the interface members may be adhered or bonded to the stiffener body parts.

Figure 7:
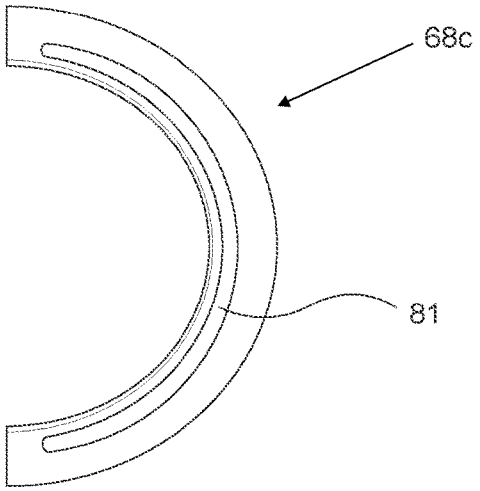
FIG. 7 is a plan view of an interface member used in embodiments of the present invention.
Figures 8A, 8B, 8C, 8D, 8E:
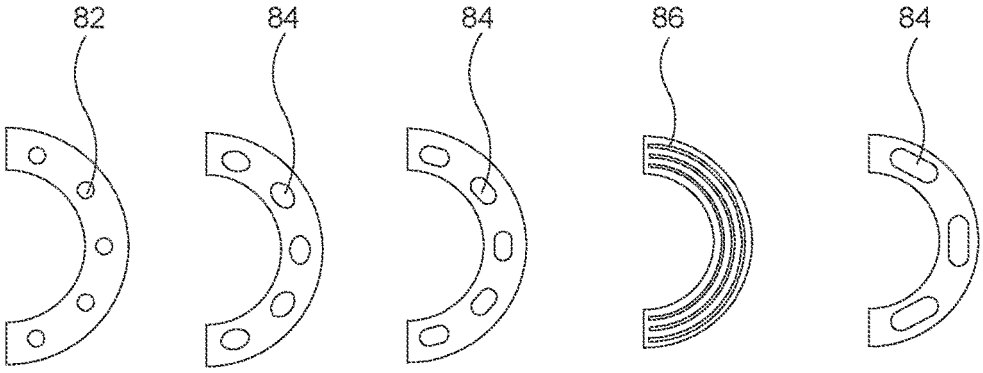
Figures 8F, 8G, 8H:
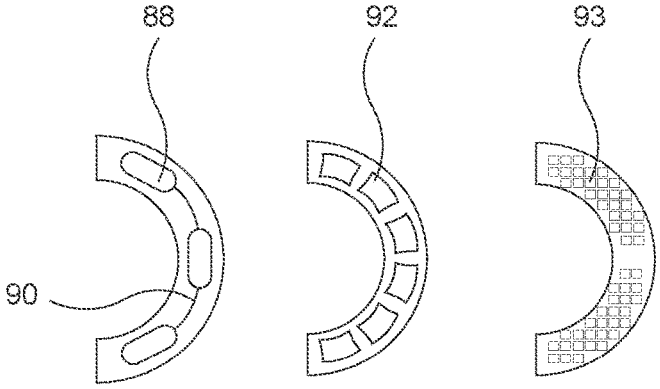

The interface members may take a variety of forms. They may in particular be part-circular plates. FIG. 7 shows one possible form, which is a generally "C" shaped plate 68*c*. The interface member may have one or more shaped features—openings, recesses, projections, channels, undercuts, flanges, tongues, grooves, dovetails, threads, bars etc.—to improve mechanical engagement with the stiffener body parts. Through-going openings are especially advantageous in this respect. The example in FIG. 7 has a through-going groove 81 extending part way around its circumference, so that a tongue of the material of the stiffener body part passes through it to secure it in place. FIGS. 8*a*-8*h* show a range of design alternatives respectively having:

through-going openings 82, which may be round (FIG. 8*a*);

through-going slots 84 (FIGS. 8*b*, 8*c*, 8*e*);

circumferentially extending slots 86 (FIG. 8*d*);

wide slots 88 joined by narrower slots 90 (FIG. 8*f*);

sectoral openings 92 (FIG. 8*g*); and a wire mesh 93 (FIG. 8*h*).

Figure 9A:
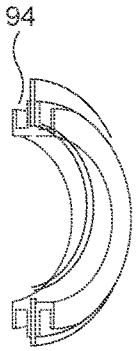
Figure 9B:
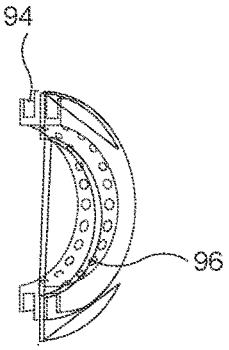
Figure 9C:
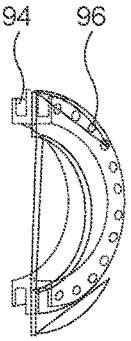
Figure 9D:
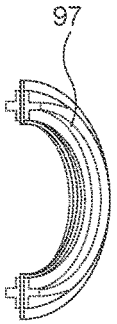
Figure 9E:
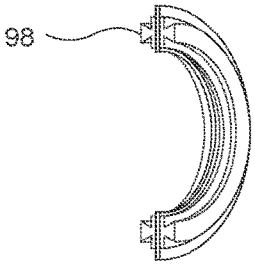

The cross section of the interface member may also be formed in such a manner as to improve engagement of the interface member with the material of the stiffener body part. FIGS. 9*a*-9*e* show several examples, respectively having:

circumferential channels 94 (FIGS. 9*a*, 9*b*, 9*c*);

a combination of such channels 94 with through-going openings 96 (FIGS. 9*b*, 9*c*);

circumferential upstands 97 (FIG. 9*d*); and circumferential undercut upstands, more specifically dovetails 98 (FIG. 9*e*).

Figure 10A:
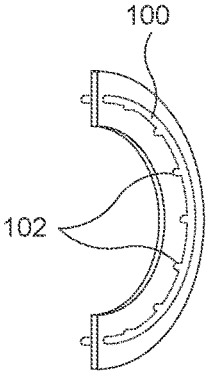
Figure 10B:
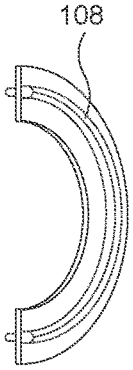
Figure 10C:
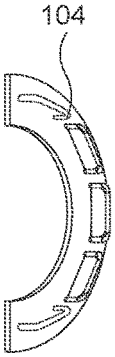
Figure 10D:
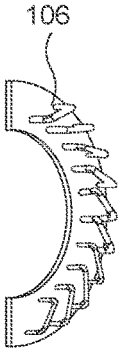

The interface member may be provided with one or more projecting features such as shaped bars to improve engagement of the interface member with the material of the stiffener body part. FIGS. 10*a*-10*d* show examples having elongate circumferentially extending bars 100 supported at intervals by legs 102 (FIG. 10*a*);

"U" shaped bars 104 whose crosspiece extends circumferentially (FIG. 10*c*);

"U" shaped bars 106 whose crosspiece is inclined to the circumferential direction (FIG. 10*d*); and circumferential ribs 108 (FIG. 10*b*).

Ends of the interface members 68, 70 form abutment surfaces 78, 79—see FIG. 4 in particular. In the assembled bend stiffener the abutment surfaces 78, 79 of the interface members 68*a*, 70*a* of one stiffener body part 64*a* abut against those of the other body part 64*b* and thus provide the main interface between the stiffener body parts. The means used to secure the interface members to one another may be pre-stressed. In the embodiment depicted in FIG. 6, for example, the bolts used for this purpose will necessarily be tightened. The consequent force can however be reacted wholly or at least substantially by the interface members through their abutment with one another, making it unnecessary to heavily pre-stress the polymer material of the stiffener bodies and avoiding any problem of loss of bolt force due to creep of the polymer material.

In the embodiment of FIGS. 3 to 5 the abutment faces 78, 79 lie in the plane of the split between the stiffener body parts, giving a flush fit. FIGS. 11 and 12 represent an alternative in which the interface members 68*a/b*, 70*a/b* stand slightly proud of the adjacent contact faces 72, 74 of the stiffener body parts 64*a*, 64*b* providing a separation (gap) 110 between these parts. This separation can facilitate manufacture and can also improve dissipation of heat from the flexible member within, in use, by allowing passage of water. In the case of an oil riser, for example, the oil emerges from the well at elevated temperature and dissipation of some heat may be advantageous.

The abutment faces 78, 79 of the interface members could alternatively lie somewhat beneath the adjacent contact faces 72, 74 of the stiffener body parts which would thus be somewhat deformed in compression during assembly, to ensure that no gap exists.

Figure 13A:
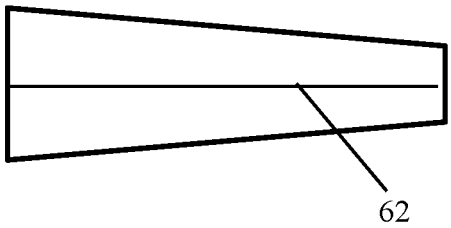
Figure 13B:
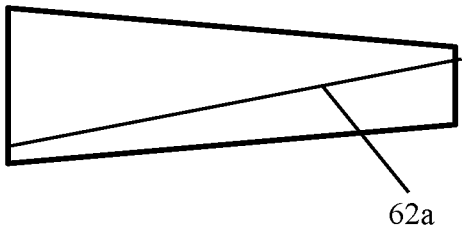

In the embodiment of FIGS. 3 to 5 the stiffener body parts meet one another in a flat split plane 62 but this need not be the case in other embodiments. The division between stiffener body parts may for example be shaped to enable positive registration of the stiffener body parts with one another and/or to suitably transmit stress, especially in shear, between the parts. Such shaping may also facilitate manufacture, and/or relieve stress concentrations which might limit fatigue life. FIGS. 13*a* and 13*b* represent embodiments in which the split plane is non-straight when viewed along a radial direction. FIG. 14 represent embodiments in which the plane is non-straight when viewed along an axial direction.

Figure 13C:
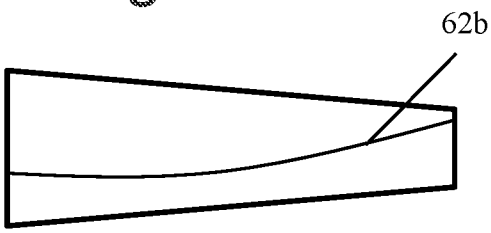
Figure 13D:
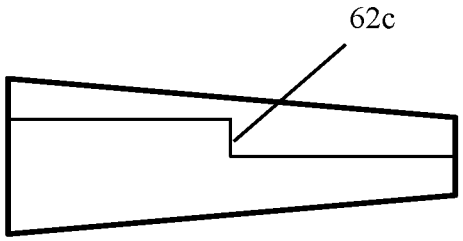
Figure 13E:
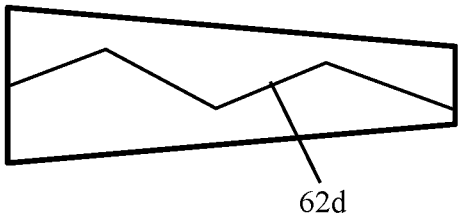
Figure 13F:
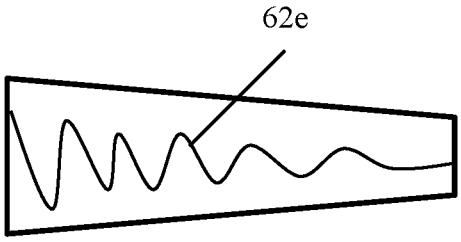
Figure 13G:
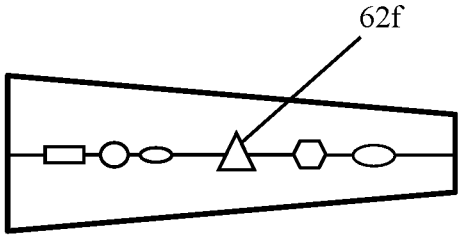
Figure 13H:
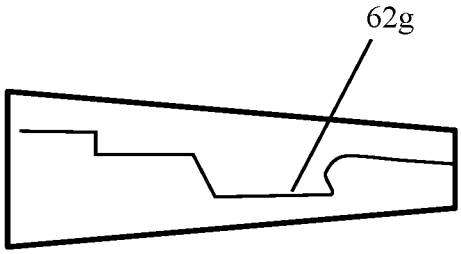

Looking at FIGS. 13*a*-13*h*, the split plane may, viewed along the radial direction, be straight, and coincident with the axis, as seen at 62 (FIG. 13*a*);

straight but inclined to the axis as at 62*a* (FIG. 13*b*);

gently curved as at 62*b* (FIG. 13*c*);

stepped as at 62*c* (FIG. 13*d*);

sawtooth or zig-zagged, as at 62*d* (FIG. 13*e*);

curved back and forth in a sinusoid or some variant thereof as at 62*e* (FIG. 13*f*);

formed with geometric shapes as at 62*f* (FIG. 13*g*); and some more complex shape as at 62*g* (FIG. 13*h*).

Looking at FIGS. 14*a*-14*l* and 14*o*), the split plane may, viewed along the axial direction, be straight and coincident with the axis, as seen at 62 (FIG. 14*a*);

straight but offset from the axis, as seen at 62*h* (FIG. 14*c*);

formed by non-coincident straight lines on opposite sides of the passage 58, as at 62*i*, 62*j* and 62*k* (FIGS. 14*b*, 14*d*, 14*e*);

formed by shallow curves as at 62*l*, 62*m* and 62*n* (FIGS. 14*f*, 14*k*, 14*o*);

formed by convoluted lines as at 62*p* and 62*q* (FIGS. 14*g*, 14*h*, 14*l*);

formed by "V" shaped lines as at 62*r* (FIG. 14*i*); and undercut as at 62*s* (FIG. 14*j*).

In this case the split plane forms a pair of interlocking dovetails so that assembly involves sliding one of the stiffener body parts axially along the other. This formation resists separation of the two parts along the radial direction.

Also while the above described embodiments comprise two bend stiffener bodies, other embodiments may have three, four or more of them—see items 62*t* and 62*u* in FIGS. 14*m* and 14*n*, respectively. A configuration using three bend stiffener bodies is considered potentially advantageous in terms of distribution of shear forces between the bend stiffener bodies. These may for example form three 120 degree segments as at 62*t* in FIG. 14*m*.

In embodiments where there are two stiffener body parts symmetrically split about a flat plane, as at 62 in FIG. 13*a*, the stiffness of the bend stiffener may be different in respect of (a) loads lying in the split plane and (b) loads perpendicular to it. Refer in this regard to FIGS. 22*a*-22*c*. In this case there is a gap between the stiffener body parts at the split plane 62. Where the bend stiffener is stressed in a direction parallel to the split plane 62, as indicated by an large arrow in FIG. 22*b*, the absence of material in the split plane 62, in a region which is highly stressed, makes the bend stiffener less stiff under loading in this direction than under loading in the direction perpendicular to the split plane 62 (see the arrow in FIG. 22*a*). This is expected to be acceptable in certain applications. However where it is not acceptable, various solutions are available. One is to divide the stiffener body into three or more parts, as at 62*t* in FIG. 14*m*. Another is to shape the stiffener body to compensate for the difference in stiffness due to the split plane. For example the stiffener body may be wider along the direction parallel to the split plane than along the direction perpendicular to it. It may for example be oval, as in FIG. 22*c*.

FIGS. 15 to 21 illustrate various alternative forms that the coupling 66 at the root end of the bend stiffener may take, in accordance with an aspect of the present invention. Looking first of all at FIG. 15, the illustrated coupling 266 comprises a coupling body 200 comprising a flange 202 and a tubular sleeve 204 concentric with and secured to the flange 202 and surrounding a through-going opening 206 in it. The coupling 266 is to be incorporated into the moulded bend stiffener body (such as 64*a, b* in FIGS. 3 to 5) during the moulding process and to form a rigid and durable connection to it, to sustain the dynamic bending loads to which the bend stiffener is subject over an extended design lifetime. It further comprises a mounting structure which is to engage with the material of the bend stiffener body, being surrounded and embraced by the material. In the FIG. 15 embodiment, the mounting structure comprises a plurality of shaped upstands 208 at circumferential intervals around the coupling body 200. Each upstand comprises a shaped elongate member having two ends, both of which are secured to the coupling body 200 to securely mount the upstand 208 to the coupling body 200. In the FIG. 15 embodiment the upstands 208 each comprise a bar shaped to form an "n" shape whose ends are secured to the flange 202.

According to the present example, the ends of the upstands 208 are secured to the coupling body 200 by means of mechanical fasteners, and more specifically threaded fasteners, as illustrated in FIG. 21. An end portion of the bar forming the upstand 208 has a shoulder 210 leading to a reduced diameter portion 212 received in a bore 214 in the flange 202. The reduced diameter portion 212 is externally threaded to receive a nut 216, tightening which draws the shoulder 210 against a flat first face 218 of the flange 202 and so secures the upstand 208 in position and maintains it in an upright orientation with respect to the flange 202. The nut 216 may be received in a counterbore 220 in a second face 222 of the flange opposite the first face so that it lies beneath the second face 222 and does not prevent that face from sitting flat against another surface, to mount the bend stiffener. The second face 222 of the flange 202 may be exposed, in the finished bend stiffener, so that nuts 216 are able to be checked for tightness.

The coupling 266 can be manufactured and assembled rapidly, in comparison with the prior art coupling of FIG. 15, since no welding is required to secure the upstands 208. Its fatigue behaviour is straightforward to model and can be good since welding is not necessary and areas of stress concentration in the FIG. 15 coupling are dispensed with.

The coupling body 200, comprising the flange 202 and the sleeve 204, can be fabricated by welding the flange to the sleeve, or the flange and sleeve may be integrally formed by forging or machining.

The upstands 208 are formed in the present embodiment as solid shaped metal bars of circular cross section, but in other embodiments they may be hollow and they may have a different cross section, e.g. square or box section.

The upstands 208 may, as in the FIG. 15 embodiment, have bends lying in a flat plane. Alternatively they may be curved in more than one plane. The embodiment in FIG. 16, for example, differs from that in FIG. 15 in that the upstands 208*a* are each part-circular, viewed in plan.

In FIGS. 15 and 16 the upstands are aligned circumferentially in plan and lie on a common circle without overlapping. The embodiment in FIG. 17 is different in that although the upstands 208*b* are once more arranged at circumferential intervals and lie in a circle, they are each inclined at a common angle to the tangent to that circle on which they lie, with one end of each upstand 208*b* somewhat overlapping the adjacent end of its neighbour.

The upstands need not all be the same size and shape. The embodiment illustrated in FIG. 18 has two concentric rings of upstands 208*c*, 208*d*, those in the outer ring being somewhat smaller than those in the inner ring.

The upstands need not be "n" shaped. FIG. 19 illustrates an embodiment in which the upstands 208*e* have a convoluted back-and-forth curving portion 224.

In the embodiment illustrated in FIG. 20, the upstands 208*f* are aligned radially rather than circumferentially, making it possible to provide a larger number of them. The sleeve 204 may be dispensed with in certain embodiments, as seen in FIG. 20, where the upstands 208*f* provide the requisite rigidity to sustain loads otherwise reacted by the sleeve.

The types of coupling depicted in FIGS. 15 to 21 lend themselves well to use in a split bend stiffener such as the ones depicted in FIGS. 3 to 14 since they can easily be manufactured in two or more parts. In FIG. 15, for example, the coupling body 200 is separable into two halves along a split line 226. Provision may be made for the parts of the coupling body 200 to be secured to one another, e.g. by use of bolts or other mechanical fasteners.

However these types of coupling are also well suited to use in bend stiffeners which are not split, in which case the coupling body 200 can be in the form of a continuous ring.

FIGS. 23 through 26 represent a further bend stiffener 150 embodying the present invention, comprising a pair of stiffener body parts 164*a*, 164*b* coupled together to form a generally frusto-conical and hollow stiffener body 152. A pair of semi-annular interface members 168*a,b* is used to couple the stiffener body parts 164*a,b*. Whereas in the earlier embodiment the interface members were couple by means of a fastener (machine screw 83) acting along a circumferential direction, in the present embodiment the fasteners used to secure the interface members 168*a,b* act along an axial direction and so do not impose a circumferential load on the parts. FIG. 23 shows the details. Part-annular joining plates 190 are provided on either side of exposed, radially upstanding portions of the interface members 168*a,b*, each extending from one member 168*a* to the other 168*b*. Axially oriented threaded fasteners 192 pass through aligned bores 194 in the joining plates and the interface members to secure them together. Note that a panel 196 shown in these drawings covering the root end of the bend stiffener forms no part of the bend stiffener itself and would be removed prior to deployment.

The interface members may be provided with alignment features to ensure that one properly aligns with the other. FIGS. 27 and 28 provide an example. FIG. 28 is cut away to reveal an alignment pin 298 passing through aligned bores in the two interface members 268*a,b*. Elongate washers 299 are secured by the machine screws 283 and cover the pins, keeping them in position.

The interface members may be used for handling of the bend stiffener, and/or of its parts, and may be provided with engagement features for this purpose. FIGS. 29 and 30 show a dedicated tool 300 being used to carry the bend stiffener body parts 364*a,b*. The tool can be used to open and close the bend stiffener by means of pivoting arms 302. The arms engage the bend stiffener body parts through the interface members 368, 370. In this way handling and alignment of the components—which may be too large for manual handling—is facilitated.

The aforegoing embodiments are presented by way of example and not limitation and numerous variations are possible without departing from the scope of the invention according to the appended claims. For example while the embodiments described above use two pairs of interface members 68*a/b* and 70*a/b* forming two loop around the stiffener body 52, a different number of interface members could be used. For example three or more pairs could be provided. Also whereas the interface members of the illustrated embodiments extend, when coupled to one another, around the full circumference of the stiffener body 52, that need not be the case in other embodiments of the invention.

The stiffener body parts may be coupled to one another by a hinge, in which case opening them out to receive the flexible member 60 involves turning one relative to the other about the hinge.

The invention claimed is:

1. A bend stiffener for locally protecting an elongate flexible member from excessive curvature, the bend stiffener comprising:

an elongate stiffener body which includes polymer material and which has a root end and a free end, a passage extending through the stiffener body from the root end to the free end for receiving and embracing the flexible member, a coupling at or toward the root end of the stiffener body for mounting the stiffener body in cantilever fashion, the stiffener body being capable of curving somewhat along with the flexible member when the flexible member suffers a bending load but resistant to excessive curvature which could otherwise damage the flexible member, and being resilient such that the stiffener body is able to recover its original shape upon relief of the bending load, the stiffener body having at least two stiffener body parts which together define the passage and which are able to be separated from one another to enable the flexible member to be introduced to the passage, and subsequently assembled to one another around the flexible member to ready the bend stiffener for use, each of the stiffener body parts being provided with a respective interface member which includes material which is stiffer than the polymer material of the stiffener body, each of the stiffener body parts having first and second contact faces, each contact face of one stiffener body part abutting a contact face of another stiffener body part in the assembled bend stiffener, each of the interface members extending from the first contact face of its stiffener body part to the second contact face of the same stiffener body part, and each of the interface members having first and second end faces, and securing arrangements being provided for securing and abutting one of the end faces of the interface member of one stiffener body part to one of the end faces of the interface member of another stiffener body part, the end faces being in abutment, to secure the stiffener body parts to one another, wherein the stiffener body parts are moulded polymer items and the interface members are incorporated into the moulded stiffener body parts.

2. The bend stiffener as claimed in claim 1, wherein the interface members are embedded in the stiffener body parts.

3. The bend stiffener as claimed in claim 1, wherein the stiffener body parts are secured to one another in the assembled bend stiffener only through the interface members and the securing arrangements.

4. The bend stiffener as claimed in claim 1, wherein the securing arrangements include any of a threaded fastener, a tension strap, adhesive, adhesive tape, a locking pin and a latch.

5. The bend stiffener as claimed in claim 1, wherein the securing arrangements having holes, bores, or slots in the interface members arranged to receive a threaded member to draw one of the end faces of one of the interface members into abutment with one of the end faces of another of the interface members from another of the bend stiffener body parts.

6. The bend stiffener as claimed in claim 1, wherein in use, neighbouring interface members together form a continuous loop around the flexible member.

7. The bend stiffener as claimed in claim 1, wherein the interface members include any one or more of metal, fibre reinforced plastics, carbon fibre reinforced plastics and glass fibre reinforced plastics.

8. The bend stiffener as claimed in claim 1, wherein the interface members are provided with shaped locating features to enable one of the interface members to positively locate with respect to another of the interface members.

9. The bend stiffener as claimed in claim 1, wherein the at least two stiffener body parts number two, the stiffener body is substantially circular in cross section and is split into two stiffener body parts in a plane that passes through an axis of the stiffener body.

10. The bend stiffener as claimed in claim 1, wherein the first and second contact faces of each bend stiffener body part, both being non-flat, the contact faces of one of the bend stiffener body parts being complementarily shaped to the contact faces of another of the bend stiffener body parts with which the contact faces of both bend stiffener body parts abut so that the contact faces of both bend stiffener body parts contact one another over substantially an entire area of the contact faces of both bend stiffener body parts.

11. The bend stiffener as claimed in claim 1, wherein each interface member having an abutment surface being set back from one of the contact faces of the respective bend stiffener body part so that bringing the abutment faces of neighbouring stiffener body parts into abutment involves deformation of the stiffener body parts, biasing the first and second contact faces toward one another.

12. The bend stiffener as claimed in claim 1, wherein at least one of the interface members has at least one through-going opening through which the material of the stiffener body part passes where the stiffener body part is the stiffener body part to which the interface member is attached.

13. The bend stiffener as claimed in claim 1, wherein at least one of the interface members has any one or more of the following features which is embedded in the material of its associated stiffener body part:

a hole,
a slot,
a circumferentially extending slot,
a mesh,
an upstand,
a rib,
a circumferential rib,
a projecting limb or bar,
a "U" or "C" shaped bar, and
a dovetail.

14. The bend stiffener as claimed in claim 1, wherein the stiffener body parts are secured to one another in the assembled bend stiffener only through the interface members and the securing arrangements.

15. The bend stiffener as claimed in claim 1, wherein the securing arrangements include at least one threaded fastener.

16. The bend stiffener as claimed in claim 1, wherein the securing arrangements include at least one locking pin.

17. The bend stiffener as claimed in claim 1, wherein the securing arrangements having holes, bores, or slots in the interface members arranged to receive a threaded member to draw the first end face of one of the interface members into abutment with the second end face of another of the interface members from another of the bend stiffener body parts.

18. The bend stiffener as claimed in claim 1, wherein the securing arrangements having holes, bores, or slots in the interface members arranged to receive a threaded member to draw the second end face of one of the interface members into abutment with the first end face of another of the interface members from another of the bend stiffener body parts.

* * * * *